US010438710B2

(12) United States Patent
Subiry

(10) Patent No.: US 10,438,710 B2
(45) Date of Patent: Oct. 8, 2019

(54) SYSTEMS AND METHODS FOR DRY STORAGE AND/OR TRANSPORT OF CONSOLIDATED NUCLEAR SPENT FUEL RODS

(71) Applicant: NAC INTERNATIONAL INC., Norcross, GA (US)

(72) Inventor: Juan C. Subiry, Atlanta, GA (US)

(73) Assignee: NAC INTERNATIONAL, INC., Norcross, GA (US)

( * ) Notice: Subject to any disclaimer, the term of this patent is extended or adjusted under 35 U.S.C. 154(b) by 287 days.

(21) Appl. No.: 15/398,800

(22) Filed: Jan. 5, 2017

(65) Prior Publication Data

US 2017/0110209 A1 Apr. 20, 2017

Related U.S. Application Data

(62) Division of application No. 13/957,919, filed on Aug. 2, 2013, now Pat. No. 9,558,857.

(60) Provisional application No. 61/678,702, filed on Aug. 2, 2012.

(51) Int. Cl.

| | |
|---|---|
| ***G21C 19/00*** | (2006.01) |
| ***G21F 5/012*** | (2006.01) |
| ***G21F 5/10*** | (2006.01) |

(52) U.S. Cl.

CPC ..... *G21F 5/012* (2013.01); *G21F 5/10* (2013.01)

(58) Field of Classification Search

CPC . G21F 5/00; G21F 5/005; G21F 5/008; G21F 5/012; G21F 5/02; G21F 5/06

See application file for complete search history.

(56) References Cited

U.S. PATENT DOCUMENTS

| | | | | |
|---|---|---|---|---|
| 4,663,533 | A | 5/1987 | Kok et al. | |
| 4,723,359 | A * | 2/1988 | Blissell | G21C 19/34 29/723 |
| 4,800,283 | A | 1/1989 | Efferding | |
| 5,615,240 | A | 3/1997 | Wolters, Jr. et al. | |
| 6,064,710 | A * | 5/2000 | Singh | G21F 5/012 376/272 |
| 2005/0117687 | A1 | 6/2005 | Carver et al. | |
| 2008/0031396 | A1 | 2/2008 | Singh et al. | |
| 2010/0272225 | A1 | 10/2010 | Singh | |

FOREIGN PATENT DOCUMENTS

| | | |
|---|---|---|
| TW | 233365 | 11/1994 |

OTHER PUBLICATIONS

Foreign search report for PCT/US2013/053401 dated Jan. 16, 2014.
Taiwan Office Action issued in related, co-pending Taiwan Application No. 102127723, dated Mar. 29, 2017.

* cited by examiner

*Primary Examiner* — Marshall P O'Connor
(74) *Attorney, Agent, or Firm* — Thomas | Horstemeyer, LLP

(57) ABSTRACT

In one embodiment, a system and method for dry storage comprises removing spent fuel rods from their fuel rod assemblies and placing the freed fuel rods in a storage cell of a dry storage canister with a high packing density and without a neutron absorber material present.

15 Claims, 9 Drawing Sheets

SYSTEMS AND METHODS FOR DRY STORAGE AND/OR TRANSPORT OF CONSOLIDATED NUCLEAR SPENT FUEL RODS

CLAIM OF PRIORITY

This application is a divisional application and claims priority to application Ser. No. 13/957,919, filed Aug. 2, 2013, which application claims priority to U.S. Provisional Application No. 61/678,702, filed Aug. 2, 2012, which is hereby incorporated by reference herein in its entirety.

BACKGROUND

Nuclear fuel assemblies for powering nuclear reactors generally comprise large numbers of fuel rods that are contained in discrete fuel rod assemblies. These assemblies typically comprise a bottom end fitting or nozzle, a plurality of fuel rods extending upwardly therefrom and spaced from each other in a square or triangular pitch configuration, spacer grids situated periodically along the length of the assembly for support and orientation of the fuel rods, a plurality of control guide tubes interspersed throughout the assembly, and a top end fitting or cap. Once assembled, the fuel rod assembly can be installed within and removed from the reactor as a unit.

When the nuclear fuel rods have expended a large amount of their available energy, they are considered to be "spent," and the fuel rod assembly is removed from the reactor and temporarily stored in an adjacent pool until they can be transported to an interim storage facility, reprocessing center, or to a permanent storage facility or repository. Even though the rods are considered to be spent, they are still highly radioactive and hazardous both to people and property.

There are a number of options available for storing and disposing of the radioactive spent fuel rods. In one such option, the fuel rod assemblies are contained within a dry storage system that can be transported offsite to another facility. In such systems, the fuel rod assemblies are typically placed, without water, within cylindrical canisters, which are then placed within transport casks.

Transportable canister-based dry spent fuel storage systems must comply with multiple federal regulatory requirements, including both storage and transport requirements. Systems that are licensed for storage must meet safety design conditions imposed by 10 CFR Part 72, while systems that are licensed for transport must meet more challenging safety design conditions that are imposed by 10 CFR Part 71 (Part 71 hereafter). These parts are the sections of the Code of Federal Regulations that stipulate the requirements that must be complied with to obtain U.S. Nuclear Regulatory Commission (NRC) certification for the storage and transport of spent fuel.

In order to achieve NRC certification under Part 71 for transport of a dry storage system for spent fuel, the storage system must be designed such that nuclear criticality cannot be achieved under normal operations and postulated accident conditions. Nuclear criticality is a condition in which the effective neutron multiplication factor of the fuel array, $k_{eff}$, is greater than or equal to 1.0 and a nuclear chain reaction becomes self-sustaining. According to the requirements, nuclear criticality must not be achieved even if the storage system is flooded with a neutron moderator, like water, in an optimal condition that enhances the potential for criticality. Notably, no regulatory credit is given for designing the system to ensure that water intrusion is not realistically possible.

The requirement to prevent criticality even in the presence of a neutron moderator typically forces dry storage and transport system designers to produce systems that incorporate expensive neutron absorber material in the spaces between the fuel rod assemblies. The neutron absorber material ensures that, even with a neutron moderator present, $k_{eff}$ remains less than or equal to 0.95 and the system is not able to sustain a nuclear chain reaction. Unfortunately, such designs have relatively low fuel storage capacity and are expensive because of the need for the neutron absorber material. Furthermore, these systems are not perfectly suitable to be placed in a permanent repository because of exceedingly large dimensions, typical neutron absorber degradation uncertainties, and other canister material degradation concerns under long-term disposal conditions. The net result is that the cost per spent fuel assembly stored, transported, and disposed of is greatly increased.

From the above discussion, it can be appreciated that it would be desirable to have a transportable dry storage system and method that have higher spent fuel storage capacity and/or that remove the need for expensive neutron absorber material.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

Figure 1:
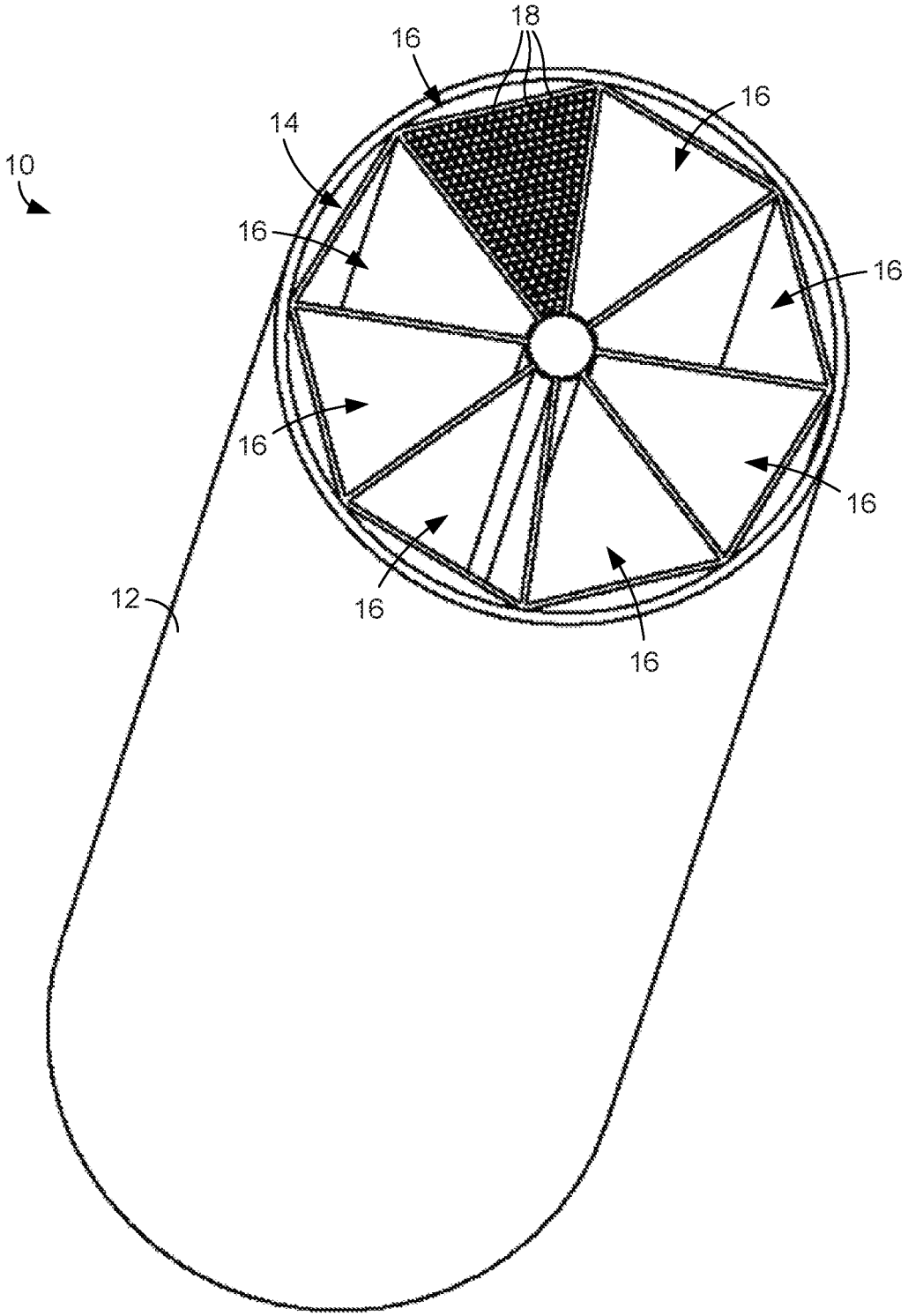
FIG. 1 is a perspective view of a first embodiment of a dry storage canister for storing spent fuel rods.

As described above, it would be desirable to have a transportable dry storage system and method that have higher spent fuel storage capacity and/or that remove the need for expensive neutron absorber materials. Examples of such systems and methods are described in the following disclosure. In some embodiments, spent fuel rods are separated from their fuel rod assemblies and the freed rods are placed within a dry storage canister that, for example, can be placed in a storage or transport cask or in a repository. Because the fuel rods are separated from the fuel rod assembly, the rods can be placed within the storage canister with a much higher packing density. As a consequence, there is less space between the rods and, therefore, less danger of the system reaching nuclear criticality if a neutron moderator such as water were to enter the canister. Because of this, there is no need to provide expensive neutron absorber material within the canister. Furthermore, because of the limited open spacing, there is minimal risk for the rods to become geometrically reconfigured within the canister, a desirable feature when analyzing transport accident conditions to meet regulatory requirements.

In the following disclosure, various specific embodiments are described. It is to be understood that those embodiments are example implementations of the disclosed inventions and that alternative embodiments are possible. All such embodiments are intended to fall within the scope of this disclosure.

As described above, in order to satisfy federal safety requirements, fuel rod assemblies are typically placed within cylindrical canisters along with expensive neutron absorber material, resulting in low spent fuel storage capacity and high costs. An alternative way to satisfy such requirements is to package spent fuel in a manner in which there are few voids between the rods that a neutron moderator material, such as water, can fill so as to reduce the potential for nuclear criticality. Accordingly, neutron absorber material is unnecessary. In addition to increasing spent fuel storage capacity and removing the need for expensive neutron absorber material, such a design may enable credits to be awarded for the effects of burnup on the nuclear fuel to decrease criticality. As nuclear fuel is used, it builds up fission products that reduce its capability to support a self-sustaining chain reaction. This process is referred to as "burnup" and it is measured in terms of megawatt days per ton. Once burnup is sufficient to prevent further power development, the fuel is typically termed "spent fuel." Possible credits could include (a) a reasonable credit for reduction in the amount of effective fissile material content of the fuel, resulting from that material being consumed by protracted fissioning during power operations, (b) a reasonable credit for effective neutron absorption by the actinides that are present in the spent fuel, and (c) a reasonable credit for effective neutron absorption by the fission products that are present in the spent fuel.

One way of achieving the above-described goals is to remove spent fuel rods from their fuel rod assemblies and place the freed rods within a dry storage canister with very little space between the rods. Doing this provides several benefits. First, the spent fuel rods will have a higher packing density within the canister and therefore a higher storage capacity can be obtained. In addition, because there is very little space between the rods, the risks associated with ingress of water or another neutron moderator are reduced and no expensive neutron absorber material is required. Furthermore, because there is less risk associated with nuclear criticality in the event of compromise of the canister, the canister can be made of relatively inexpensive materials.

When increasing the packing density in this manner, steps can be taken to ensure that the heat generated by the spent fuel rods is dissipated, especially from the center of the canister, which is farthest from the canister walls. FIGS. 1-8 illustrate various canister designs that can be used to achieve both high rod packing density as well as desirable heat dissipation.

Figure 2:
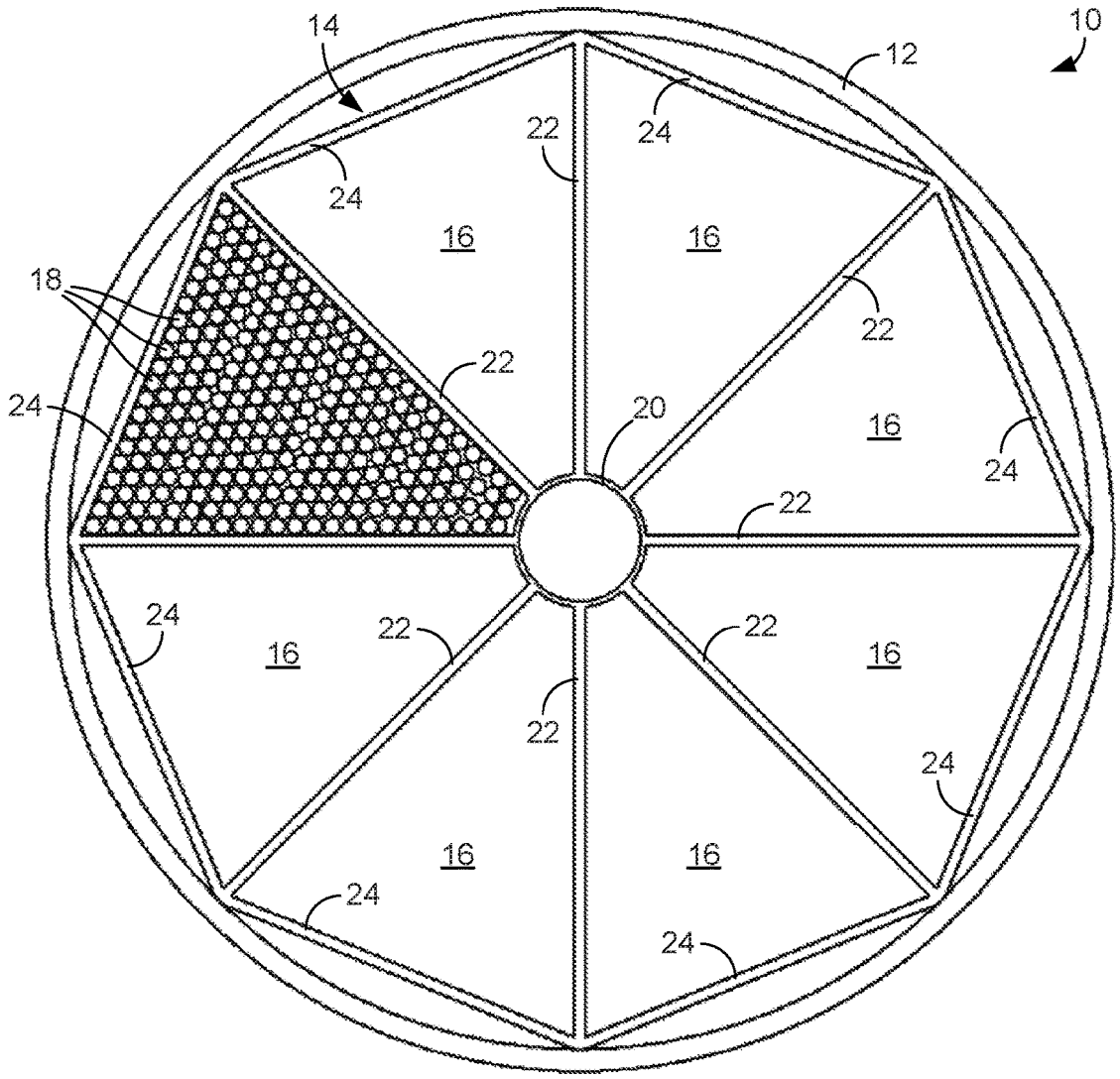
FIG. 2 is an end view of the dry storage canister of FIG. 1.

FIGS. 1 and 2 illustrate a first embodiment of a dry storage canister 10 in which free spent fuel rods (i.e., rods separated from their fuel rod assemblies) can be stored in a dry condition (i.e., without the presence of water). As shown in FIG. 1, the canister 10 generally comprises an elongated outer housing 12 in which is provided an internal basket 14 that is adapted to receive spent fuel rods and dissipate their heat. The shape and dimensions of the outer housing 12 can depend upon the size and nature of the rods it is to store and/or the size and nature of a container (e.g., cask) in which the canister is to be placed. In some embodiments, however, the outer housing 12 is cylindrical, approximately 165 to 210 inches long, and has a diameter of approximately 12 to 24 inches. The walls of the outer housing 12 can be made of a strong metal material, such as stainless steel, and can be approximately ¼ to ½ inches thick.

As shown in FIG. 1, the internal basket 14 divides the interior space of the outer housing 12 into multiple storage compartments or cells 16 in which spent fuel rods, such as rods 18, can be provided. As is apparent from FIG. 1, the cells 16 extend along the length direction of the housing 12 from one end of the housing to the other. FIG. 2 shows the configuration of the basket 14 more clearly. In the example shown in FIG. 2, the basket 14 comprises a central tube 20 from which radially extend multiple divider walls 22 that create a "pie piece" configuration for the cells 16. The divider walls 22 extend to the housing 12. Between the distal ends of the divider walls 22 extend end walls 24. With such a configuration, each cell 16 of the basket 14 is generally triangular and is defined by the central tube 20, two divider walls 22, and an end wall 24.

The various components of the internal basket 14, including the central tube 20, the divider walls 22, and the end walls 24, can be made of a metal or alloy materials having high thermal conductivity (e.g., 200 to 380 W/(m·k)). Example materials include aluminum alloys and copper. When the spent fuel has aged for many years and has lower residual heat, the basket 14 can be made of materials with lower thermal conductivity and higher strength, such as steel, to further increase packing density. The thickness and materials of these components can be selected based upon the strength that is needed as well as the amount of heat dissipation that is required. In some embodiments, however, the walls of the basket 14 are approximately ¼ to ⅝ inches thick. The number of divider walls 22 that the basket 14 includes can be varied based upon the size and number of cells 16 that are desired. In the illustrated example, however, the basket 14 comprises eight divider walls 22 that form eight separate cells 16.

In FIG. 2, only one of the storage cells 16 is shown filled with spent fuel rods 18. As is clear from the figure, the rods 18 are tightly packed within the cell 16 such that there is very little space between them. In some embodiments, the rods 18 contact each other along much of or all of their lengths. By way of example, a packing density of approximately 5 to 6 spent fuel rods per squared inch can be achieved within each cell 16 for rods of typical dimensions (e.g., 0.382 to 0.45 inches in diameter). In the illustrated example, 271 rods 18 are shown contained within the filled cell 16, in which case the canister 10, with an approximate radius of 12 inches would be able to store 2,168 such rods in total.

The internal basket 14 is configured to not only provide structural support to the spent fuel rods 18 but also to dissipate heat generated by the rods, particularly in the center of the canister, which is farthest from the walls of the outer housing 12. The basket 14 achieves this with the dividing walls 22, which transfer heat from the center of the canister 10 to the outer housing 12, which acts like a heat sink. The pie-piece configuration of the cells 16 increases this heat transfer by increasing the amount of basket material in the center of the canister 10 while simultaneously reducing the concentration of rods 18 in that location. In other words, the ratio of the mass of the heat-dissipating basket material to the mass of the fuel rod material increases as the canister 10 is traversed from the walls of the outer housing 12 to the center of the canister.

The central tube 20 also reduces the density of the spent fuel rod material near the center of the canister 10. In addition, the central tube 20 acts as a load distribution cell that spreads loads imposed upon the canister 10, for example, if the canister is impacted because of an accident. In addition, the central tube 20 can provide space for a drain tube (not shown) that is used to drain residual water that drips down to the bottom of the canister from the fuel rods during a draining and drying process performed prior to sealing of the canister 10.

Figure 3:
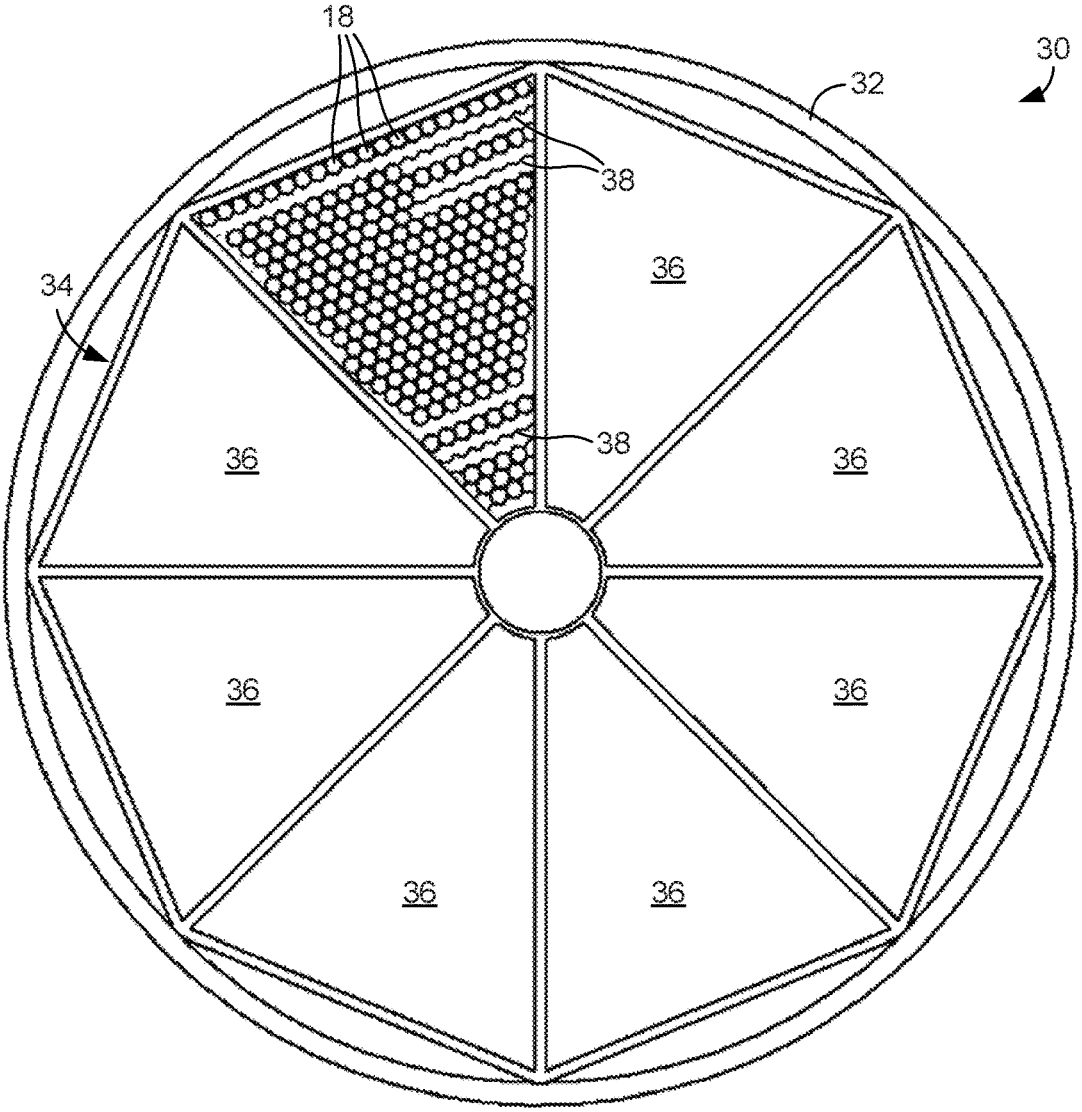
FIG. 3 is an end view of a second embodiment of a dry storage canister for storing spent fuel rods.

FIG. 3 illustrates an alternative dry storage canister 30 that is similar in many ways to the canister 10 shown in FIGS. 1 and 2. The canister 30 also generally comprises an elongated outer housing 32 and an internal basket 34 that defines multiple storage cells 36 having a pie-piece configuration. In the embodiment of FIG. 3, however, each cell 36 is provided with corrugated dividers 38 that further dissipate heat generated by the spent fuel rods 18. The dividers 38 can therefore also be made of a material having high thermal conductivity, such as aluminum alloys or copper. If the spent fuel has lower residual heat, lower thermal conductivity and higher strength materials, such as steel, can be used.

As is apparent in FIG. 3, the corrugated dividers 38 separate the spent fuel rods 18 into multiple discrete rows of rods that are generally perpendicular to the radial direction of the canister 10. With such a configuration, the dividers 38 separate the rods 18 of one row from the rods of adjacent rows. In addition, because each divider 38 is corrugated, each rod 18 within each row can be, if desired, separated from adjacent rods within its own row depending upon the configurations of the corrugations. In addition to dissipating heat from the rods 18, the dividers 38 can facilitate packing of the free fuel rods 18 into their cells 36. For example, the rods 18 and dividers 38 can be combined together separate from the canister 30 and later placed together as a preformed unit into a cell 36 of the canister. Alternatively, the dividers 38 can be positioned within the cell 36 and can be used to guide the various free rods 18 into their respective positions within the cell 36.

Figure 4:
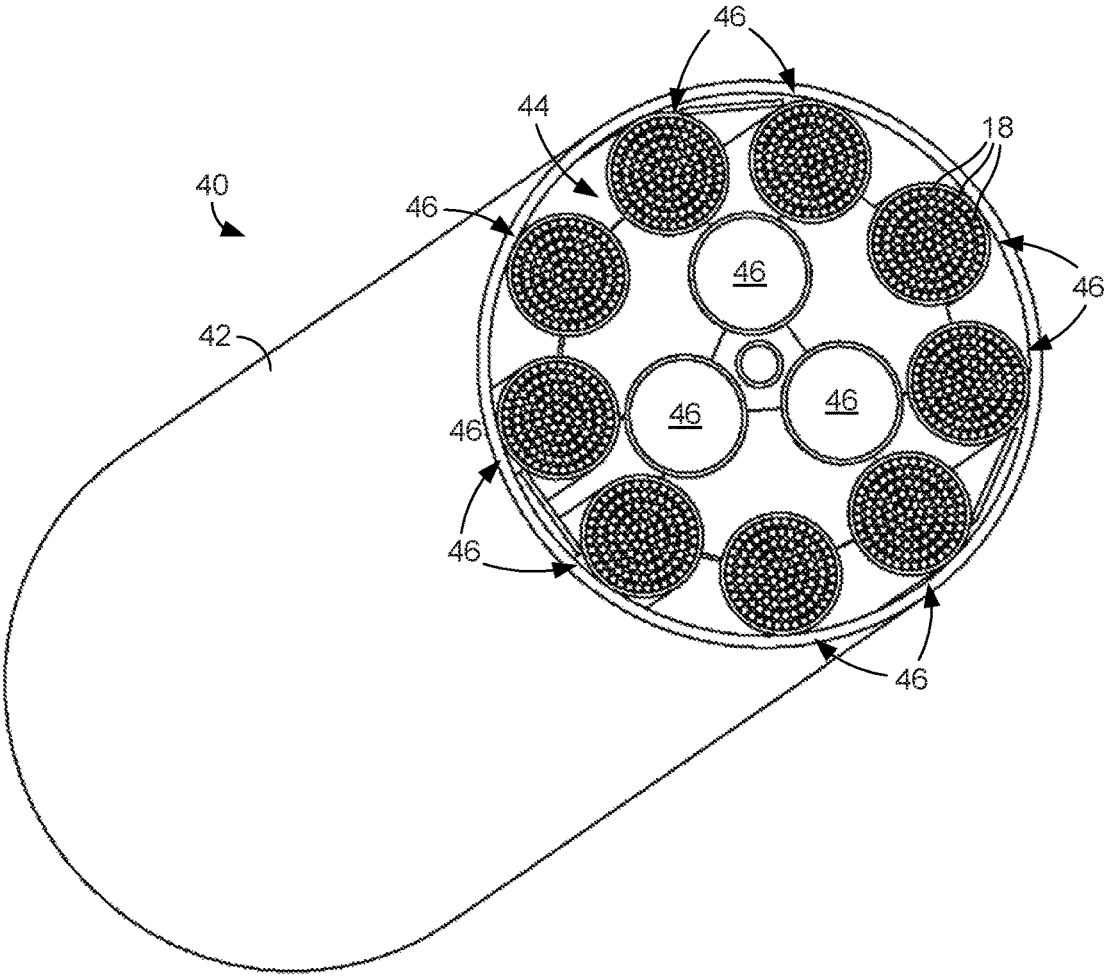
FIG. 4 is a perspective view of a third embodiment of a dry storage canister for storing spent fuel rods.
Figure 5:
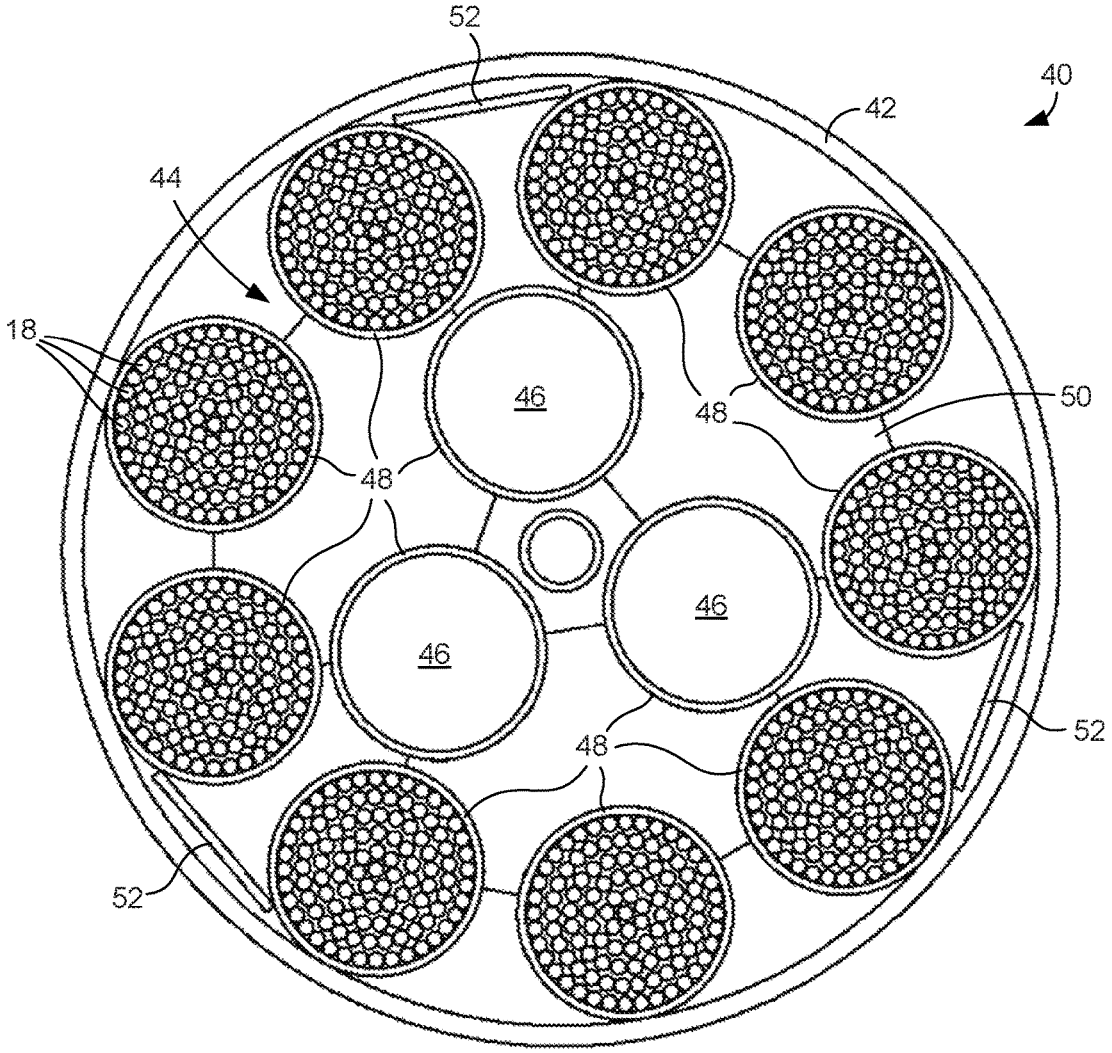
FIG. 5 is an end view of the dry storage canister of FIG. 4.

FIGS. 4 and 5 illustrate a third embodiment of a dry storage canister 40. As shown in FIG. 4, the canister 40 generally comprises an elongated outer housing 42 in which is provided an internal basket 44 that is adapted to receive spent fuel rods 18. In some embodiments, the shape, dimensions, and material of the outer housing 42 can be similar to those described above in relation to the outer housing 12 shown in FIGS. 1 and 2.

The internal basket 44 forms multiple cylindrical storage cells 46. As is apparent from FIG. 4, the cells 46 generally extend along the length direction of the outer housing 42 from one end of the housing to the other. FIG. 5 shows the configuration of the basket 44 more clearly. In the example shown in FIG. 5, the basket 44 comprises twelve storage cells 46 each formed by a cylindrical tube 48 of the basket. Although twelve cells 46 are shown in FIG. 5, it is noted that a larger or smaller number of cells could be used. By way of example, the tubes 48 can have a diameter of approximately 4 to 6 inches and also can be made of metal materials that have high thermal conductivity. Example materials include, aluminum alloys and copper. Again, if the spent fuel has lower residual heat, lower thermal conductivity and higher strength materials, such as steel, can be used. The thickness of the walls and materials of the cylindrical tubes 48 can be selected based upon the strength that is needed as well as the amount of heat dissipation that is required. In some embodiments, however, the walls of the tubes 48 are approximately ⅛ to ¼ inches thick.

In FIG. 5, nine of the storage cells 46 are shown filled with spent fuel rods 18. As is clear from the figure, the rods 18 are tightly packed within the cells 46 such that there is very little space between the rods. In some embodiments, the rods 18 contact each other along much of or all of their lengths. By way of example, a packing density of approximately 4 to 5 spent fuel rods per square inch can be achieved within each cell 46. In the illustrated example, 108 rods are shown contained within the filled cells 46, in which case the canister 40 would be able to store 1,296 such rods in total.

Spacing between the cylindrical tubes 48 is maintained by one or more spacer disks 50 that extend between the outer surfaces of the tubes. In some embodiments, one such spacer disk 50 can be positioned at least at each end of the canister 40. The spacer disks 50 can, for example, be made of the same thermally-conductive material from which the tubes 48 are made. As is further shown in FIG. 5, the internal basket 44 can further comprise elongated peripheral plates 52 that are positioned at the edges of the spacer disks 50 and extend along the length direction of the canister 40. When provided, the plates 52 provide further structural integrity to the basket 44. It is also noted that, instead of basket 44, solid aluminum cylinders having bored cylindrical channels to receive cylindrical tubes 48 could be used to separate the tubes and provide for increased heat dissipation.

Although corrugated dividers similar to those described above can be provided within the storage cells 46, if desired, it is noted that they are not likely required because the distance from the outer wall of the cylindrical tubes 48 to the centers of the tubes is not great.

Figure 6:
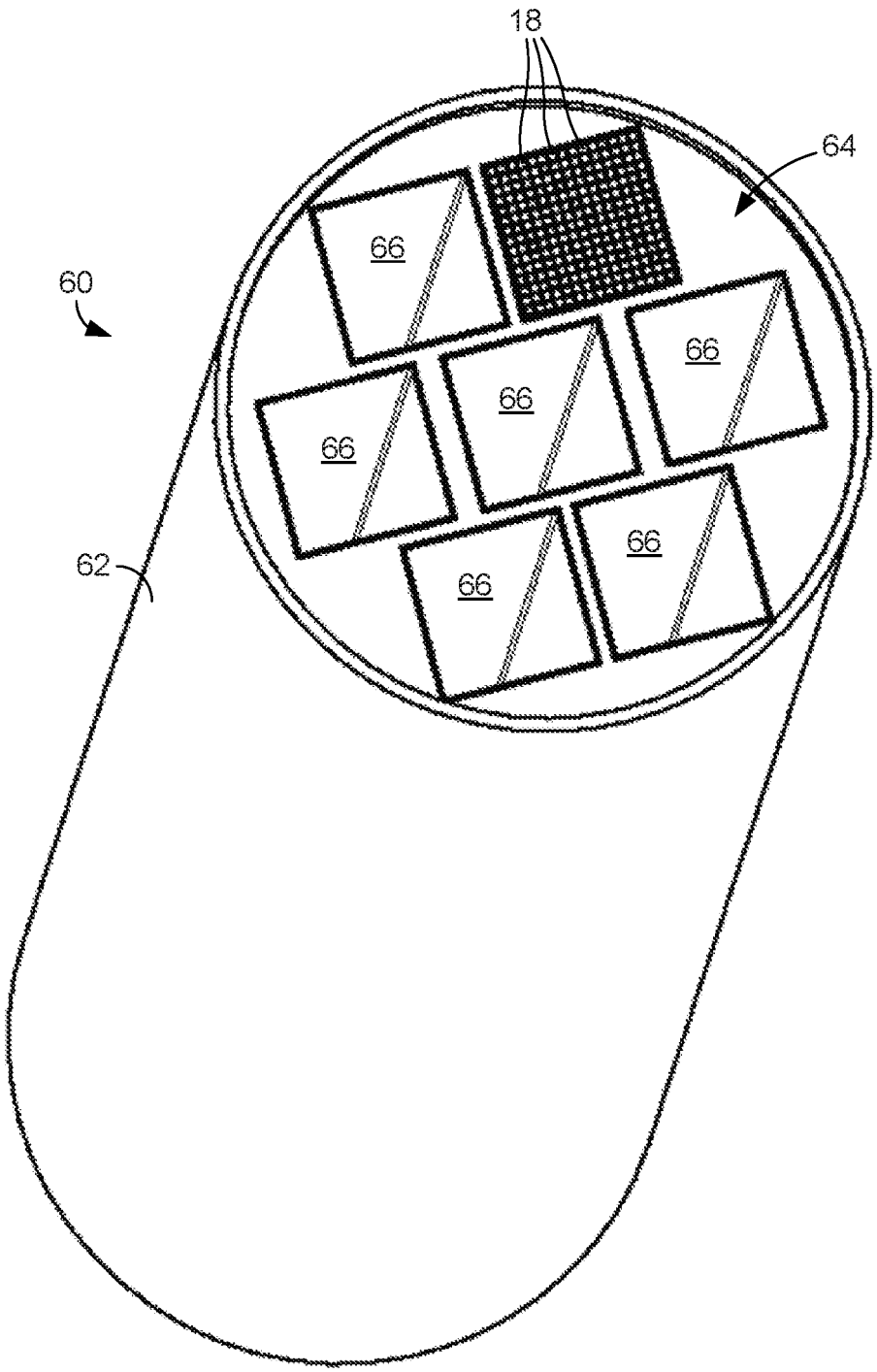
FIG. 6 is a perspective view of a fourth embodiment of a dry storage canister for storing spent fuel rods.
Figure 7:
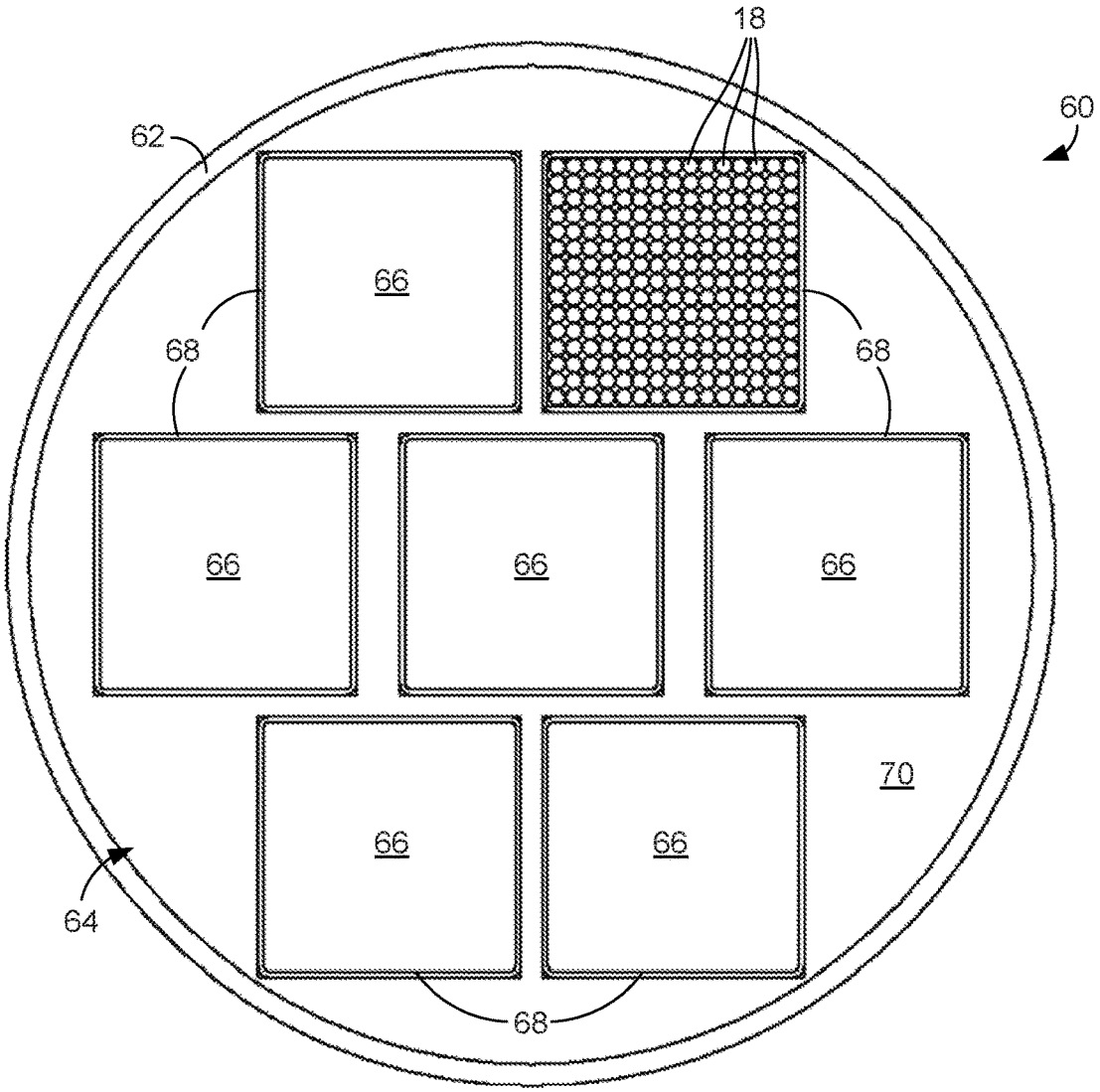
FIG. 7 is an end view of the dry storage canister of FIG. 6.

FIGS. 6 and 7 illustrate a third embodiment of a dry storage canister 60. As shown in FIG. 6, the canister 60 generally comprises an elongated outer housing 62 in which is provided an internal basket 64 that is adapted to receive spent fuel rods 18. In some embodiments, the shape, dimensions, and material of the outer housing 62 can be similar to those described above in relation to the outer housing 12 shown in FIGS. 1 and 2.

The internal basket 64 defines multiple rectangular storage cells 66. As is apparent from FIG. 6, the cells 66 generally extend along the length direction of the outer housing 62 from one end of the housing to the other. FIG. 7 shows the configuration of the basket 64 more clearly. In the example shown in FIG. 7, the basket 64 comprises seven storage cells 66 each formed by a rectangular (e.g., square) tube 68 of the basket. Although seven cells 66 are shown in FIG. 7, it is noted that a larger or smaller number of cells could be used. By way of example, the tubes 68 can have cross-sectional (height and width) dimensions of approximately 4 to 6 inches and also can also be made of metal material that have high thermal conductivity. Example materials include aluminum alloys and copper. If the spent fuel has a lower residual heat, lower thermal conductivity and higher strength materials, such as steel, can be used. The thickness of the walls of the tubes 68 can be selected based upon the strength that is needed as well as the amount of heat dissipation that is required. In some embodiments, however, the walls of the tubes 68 are approximately ¼ to ⅜ inches thick.

In FIG. 7, one of the storage cells 66 is shown filled with spent fuel rods 18. As is clear from the figure, the rods 18 are tightly packed within the cells 66 such that there is very little space between the rods. In some embodiments, the rods 18 contact each other along much of or all of their lengths. By way of example, a packing density of approximately 4 to 5 rods of spent fuel per square inch can be achieved within each cell 66. In the illustrated example, 225 rods 18 are shown contained within the filled cells 66, in which case the canister 60 would be able to store 1,575 such rods in total.

Spacing between the rectangular tubes 68 is maintained by one or more spacer disks 70 that extend between the outer surfaces of the tubes. In some embodiments, one such spacer disk 70 can be positioned at least at each end of the canister 60. In some embodiments, the spacer disks 70 can be made of the same thermally-conductive material from which the tubes 68 are made.

It is also noted that, instead of spacer disks 70, the basket 64 could comprise a solid cylindrical member having drilled rectangular channels adapted to receive tubes 68 could be used to separate the tubes and provide for increased heat dissipation.

Figure 8:
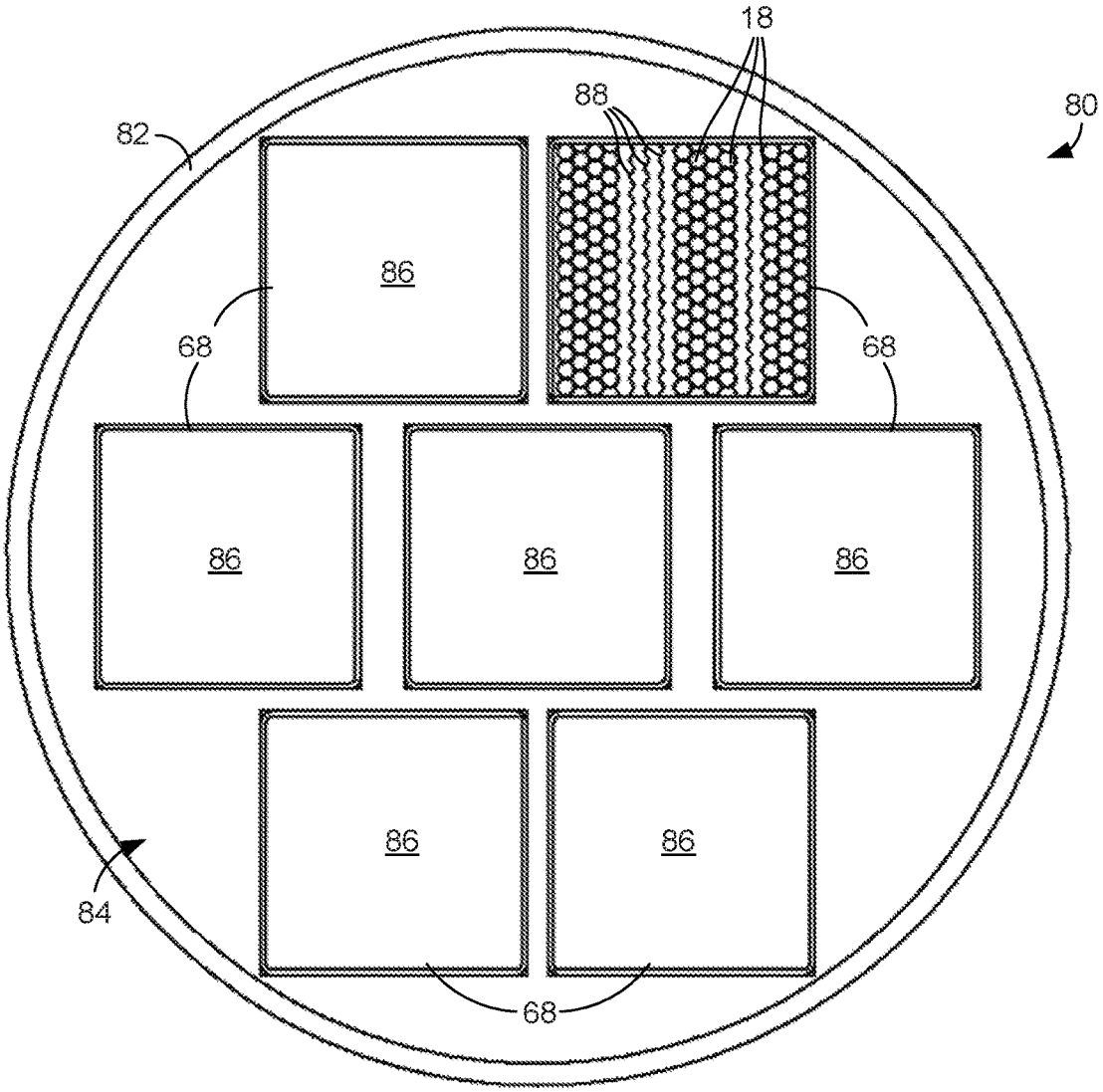
FIG. 8 is an end view of a fifth embodiment of a dry storage canister for storing spent fuel rods.

FIG. 8 illustrates a further dry storage canister 80 that is similar in many ways to the canister 60 shown in FIGS. 6 and 7. Accordingly, the canister 80 generally comprises an elongated outer housing 82 and an internal basket 84 that defines multiple storage cells 86. In the embodiment of FIG. 8, however, each cell 86 is provided with corrugated dividers 88 that further dissipate heat generated by the spent fuel rods 18. The dividers 88 can therefore also be made of a material having high thermal conductivity, such as aluminum alloys or copper. If the spent fuel has lower residual heat, lower thermal conductivity and higher strength materials, such as steel, can be used.

As is apparent in FIG. 8, the corrugated dividers 88 separate the spent fuel rods 18 into multiple discrete rows of rods. With such a configuration, the dividers 88 separate the rods 18 of one row from the rods of adjacent rows. In addition, because each divider 88 is corrugated, each rod 18 within each row can be, if desired, separated from adjacent rods within its own row. Aside from dissipating heat from the rods 18, the dividers 88 facilitate packing of the free rods into their cell 86. For example, the rods 18 and dividers 88 can be combined together separate from the canister 80 and later placed together as a preformed unit into a cell 86 of the canister. Alternatively, the dividers 88 can be positioned within the cell 86 and can be used to guide the various free rods 18 into their respective positions within the cell 86.

Figure 9:
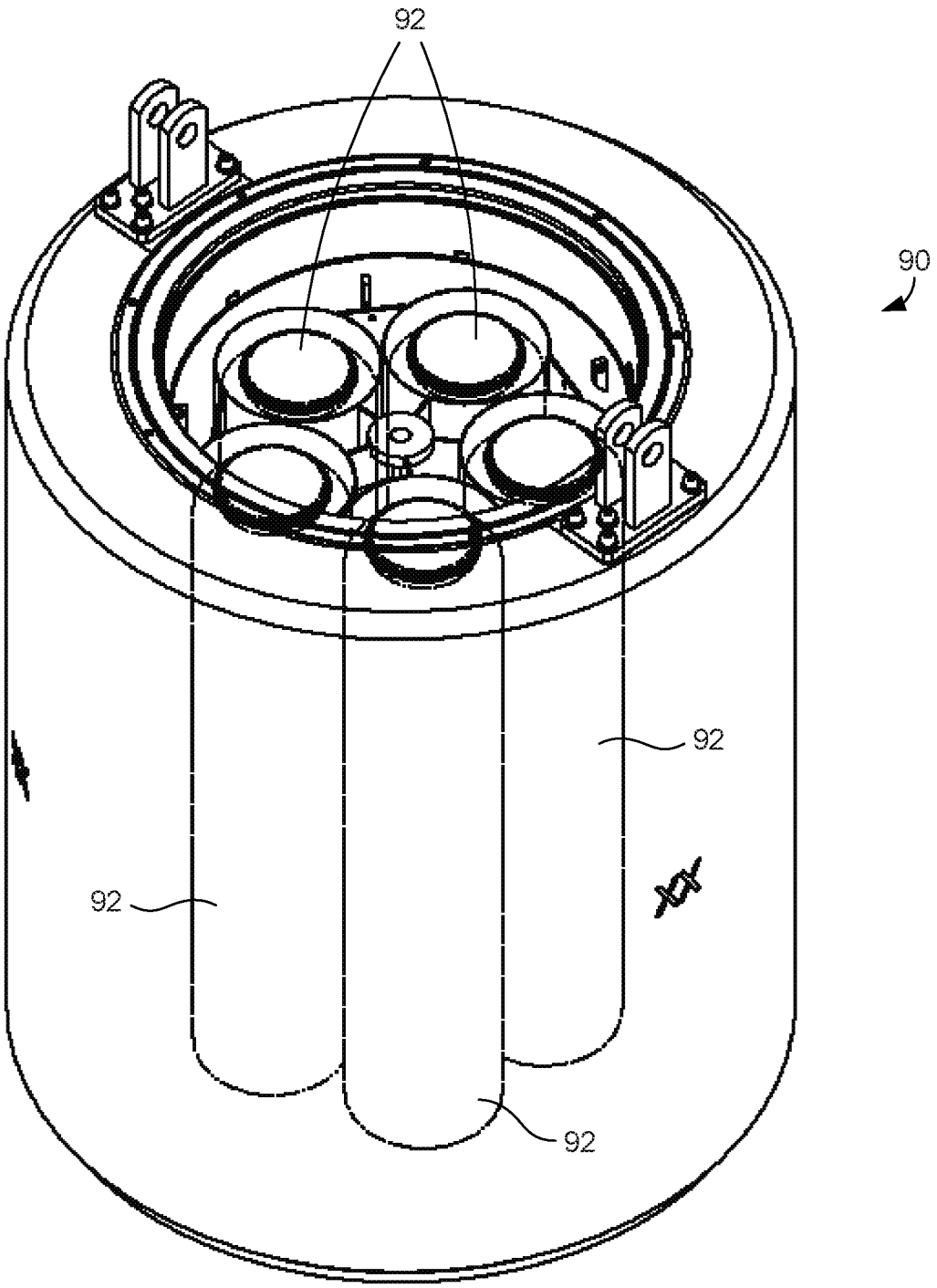
FIG. 9 is a perspective view of a cask in which multiple dry storage canisters have been provided.

Irrespective to the nature of the canisters that are used to store the spent fuel rods 18, the canisters can be placed in a storage or transport cask. FIG. 9 illustrates an example storage cask 90 in which multiple canisters 92 have been provided. In this example, the walls of the cask 90 are made of concrete. In other cases, such as when the cask is a transport cask, the walls of the cask can be made of other materials, such as stainless steel and/or lead.

The dry storage systems described in this disclosure provide numerous advantages over conventional storage systems. As noted above, much higher packaging density can be achieved and a large amount of void space is removed to limit the amount of neutron moderator (e.g., water) that can intrude, and reconfiguration of the fuel within the canister under transport and long-term disposal conditions. This eliminates need for expensive neutron absorber material. Because of the design of the canister baskets, improved heat removal can be achieved providing for a more uniform heat profile for the canisters in a geologic repository. Because of the high packing density, better shielding can be achieved with the outer rods shielding the inner rods, especially if the inner rods are hotter, high burnup fuel rods. In addition, the canister designs are relatively simple, which provides advantages in terms of structural analysis and ease of implementation. Furthermore, higher safety margins of storage can be achieved while simultaneously reducing costs. Additionally, damaged fuel rods can be managed more easily. Finally, the designs present a configuration strategy that supports efficient spent fuel packaging, fuel reprocessing, transport, and disposal, as well as standardization of storage, transport, and disposal systems.

The invention claimed is:

1. A dry storage canister for storing spent nuclear fuel rods, the canister comprising:

an elongated outer housing having a first end and a second end; and an elongated internal basket provided within the outer housing, the elongated internal basket extending in a region between the first end and the second end of the elongated outer housing, the internal basket having a plurality of separate elongated storage cells, each of the cells comprising a plurality of the spent nuclear fuel rods that have been separated from their respective fuel rod assemblies, the plurality of the spent nuclear fuel rods having a rod packing density of approximately 4 to 6 of the spent nuclear fuel rods per square inch.

2. The canister of claim 1, wherein the spent nuclear fuel rods are contiguous within each of the cells.

3. The canister of claim 1, wherein the outer housing is an elongated cylindrical housing.

4. The canister of claim 1, wherein the internal basket is made of a metal material having a high thermal conductivity.

5. The canister of claim 1, wherein the internal basket is made of one or more of carbon steel, aluminum, or copper.

6. The canister of claim 1, wherein the internal basket comprises multiple tubes that define the storage cells.

7. The canister of claim 1, further comprising a cask in which the canister is placed.

8. The canister of claim 1, wherein does not include any neutron absorbing material.

9. A dry storage canister for storing spent nuclear fuel rods that have been separated from their fuel rod assemblies, the canister comprising:

the spent nuclear fuel rods that have been separated from their fuel rod assemblies and that have been packed together with a rod packing density of approximately 4 to 6 of the spent nuclear fuel rods per square inch; and means for housing the spent nuclear fuel rods, wherein the means for housing does not include any neutron absorbing material.

10. The canister of claim 9, wherein the canister further comprises multiple tubes.

11. The canister of claim 9, wherein the spent nuclear fuel rods that have been separated from their fuel rod assemblies are contiguous within each of the cells.

12. The canister of claim 9, further comprising a central tube.

13. The canister of claim 9, further comprising a central tube that provides a space for a drain tube to drain the canister of a neutron moderator.

14. The canister of claim 1, wherein the elongated internal basket comprises a central tube.

15. The canister of claim 1, wherein the elongated internal basket comprises a central tube that provides space for a drain tube to drain the canister of a neutron moderator.

* * * * *